US009317017B2

(12) United States Patent
Kato

(10) Patent No.: US 9,317,017 B2
(45) Date of Patent: Apr. 19, 2016

(54) SATELLITE RADIO-CONTROLLED WRISTWATCH

(71) Applicants: CITIZEN HOLDINGS CO., LTD., Tokyo (JP); CITIZEN WATCH CO., LTD., Tokyo (JP)

(72) Inventor: Akira Kato, Sayama (JP)

(73) Assignees: CITIZEN HOLDINGS CO., LTD., Tokyo (JP); CITIZEN WATCH CO., LTD., Tokyo (JP)

( * ) Notice: Subject to any disclaimer, the term of this patent is extended or adjusted under 35 U.S.C. 154(b) by 0 days.

(21) Appl. No.: 14/413,703

(22) PCT Filed: Jul. 10, 2013

(86) PCT No.: PCT/JP2013/068909

§ 371 (c)(1),
(2) Date: Jan. 9, 2015

(87) PCT Pub. No.: WO2014/010646

PCT Pub. Date: Jan. 16, 2014

(65) Prior Publication Data

US 2015/0212495 A1 Jul. 30, 2015

(30) Foreign Application Priority Data

Jul. 11, 2012 (JP) ..... 2012-155974

(51) Int. Cl.
*G04R 20/04* (2013.01)

(52) U.S. Cl.
CPC ..... *G04R 20/04* (2013.01)

(58) Field of Classification Search
CPC ..... G04R 20/02
See application file for complete search history.

(56) References Cited

U.S. PATENT DOCUMENTS 6,212,133 B1 4/2001 McCoy et al.
7,920,441 B2 4/2011 Rostrom (Continued)

FOREIGN PATENT DOCUMENTS

JP 2006-162329 A 6/2006
JP 2009-053182 A 3/2009

(Continued)

OTHER PUBLICATIONS

The Quayle Action for U.S. Appl. No. 14/413,709 dated May 4, 2015.

(Continued)

*Primary Examiner* — Amy Cohen Johnson
*Assistant Examiner* — Jason Collins
(74) *Attorney, Agent, or Firm* — Hubbs, Enatsky & Inoue PLLC

(57) ABSTRACT

A reception time period required for time adjustment is reduced in a satellite radio-controlled wristwatch. A satellite radio-controlled wristwatch according to the present invention includes: a satellite radio wave reception unit including an antenna for receiving a satellite radio wave, a high frequency circuit, and a decoder circuit; a clock circuit for holding and counting an internal time; and a controller for controlling a timing of at least a time information acquisition operation of acquiring time information from the satellite radio wave received by the satellite radio wave reception unit, the controller being configured to selectively execute, in the time information acquisition operation, based on error evaluation of the internal time: a shortened time adjustment operation of ending the time information acquisition operation at a stage at which head information representing a head of unit information is received, and adjusting the internal time based on a timing at which the head information is received; and a normal time adjustment operation of receiving the time information, and adjusting the internal time based on the time information.

5 Claims, 10 Drawing Sheets

(56) References Cited

U.S. PATENT DOCUMENTS

| | | | | |
|---|---|---|---|---|
| 7,983,116 | B2 | 7/2011 | Fujisawa | |
| 8,169,857 | B2 | 5/2012 | Matsuzaki | |
| 8,188,916 | B2 | 5/2012 | Shingyoji | |
| 2003/0187575 | A1 | 10/2003 | King et al. | |
| 2008/0025151 | A1 | 1/2008 | Urano et al. | |
| 2008/0175105 | A1* | 7/2008 | Urano et al. | 368/47 |
| 2009/0015470 | A1* | 1/2009 | Fujisawa | 342/357.13 |
| 2009/0079630 | A1 | 3/2009 | Baba et al. | |
| 2009/0135674 | A1 | 5/2009 | Matsuzaki | |
| 2009/0189809 | A1 | 7/2009 | Baba | |

FOREIGN PATENT DOCUMENTS

| | | | |
|---|---|---|---|
| JP | 2011-043449 | A | 3/2011 |
| JP | 2011-226813 | A | 11/2011 |
| JP | 2012-093281 | A | 5/2012 |

OTHER PUBLICATIONS

International Search Report for PCT/JP2013/068909 dated Aug. 20, 2013.

Search Report for European Patent Application No. 13816886.9 dated Dec. 18, 2015.

Extended Search Report for European Patent Application No. 13816082 dated Feb. 2, 2016.

* cited by examiner

FIG.4

SUBFRAME 1

| WORD | BIT POSITION | BIT COUNT | CONTENT | |
|---|---|---|---|---|
| 1 | 1 | 22 | TLM | TELEMETRY WORD |
| 2 | 31 | 22 | HOW | HANDOVER WORD |
| 3 | 61 | 10 | WN | WEEK NUMBER |
| | 73 | 4 | URA | RANGE ACCURACY |
| | 77 | 6 | SVhealth | SATELLITE HEALTH STATE |
| | 83 | 2 MSB | 10DC | CLOCK INFORMATION NUMBER |
| 7 | 197 | 8 | TGD | GROUP DELAY |
| 8 | 211 | 8 LSB | 10DC | CLOCK INFORMATION NUMBER |
| | 219 | 16 | toc | EPOCH TIME (CLOCK) |
| 9 | 241 | 8 | af2 | CLOCK CORRECTION COEFFICIENT |
| | 249 | 16 | af1 | CLOCK CORRECTION COEFFICIENT |
| 10 | 271 | 22 | af0 | CLOCK CORRECTION COEFFICIENT |

SATELLITE RADIO-CONTROLLED WRISTWATCH

CROSS REFERENCE TO RELATED APPLICATIONS

This application is a National Stage of International Application No. PCT/JP2013/068909 filed Jul. 10, 2013, claiming priority based on Japanese Patent Application No. 2012-155974 filed on Jul. 11, 2012. The contents of each of the above documents are incorporated herein by reference in their entirety.

TECHNICAL FIELD

The present invention relates to a satellite radio-controlled wristwatch.

BACKGROUND ART

There has been proposed a radio-controlled wristwatch (hereinafter referred to as "satellite radio-controlled wristwatch") configured to receive a radio wave (hereinafter referred to as "satellite radio wave") from an artificial satellite used for a positioning system, such as a Global Positioning System (GPS) satellite, to thereby adjust time. Such adjustment is possible because positioning signals typified by a GPS signal contain accurate time information. An ultra-high frequency wave is used for such a satellite radio wave, and hence a larger amount of information is sent per hour as compared to a low frequency wave used for a standard radio wave, which has been used in the related art for time adjustment on the ground. As a result, the time required for reception of the time information is considered to be reduced as compared to the case where the standard radio wave is received.

In Patent Literature 1, there is disclosed a GPS-equipped wristwatch corresponding to the satellite radio-controlled wristwatch. Further, in Patent Literature 2, there is disclosed a GPS timing device configured to receive a preamble to adjust the time.

CITATION LIST

Patent Literature

[Patent Literature 1] JP 2011-43449 A
[Patent Literature 2] JP 2011-226813 A

SUMMARY OF INVENTION

Technical Problem

In the satellite radio wave, the time information is not always transmitted, but is transmitted at a certain interval determined depending on the specification of the positioning system. For example, in the case of the GPS, the time information is called time of week (TOW), and is contained in a 30-bit data string called handover word (HOW) that is transmitted every 6 seconds. That is, the timing at which the time information is receivable arrives every 6 seconds. Further, when the time information is received, it is difficult to receive only TOW. The data of the GPS is transmitted in 300-bit information called a subframe as one unit, and the head of the subframe contains 8-bit information called a preamble. Thus, each subframe is transmitted so that the head thereof can be detected. Therefore, for reception of TOW, even if it is determined that other data such as satellite orbit information is not received, it is necessary to carry out reception from at least the start of transmission of the preamble to the end of transmission of TOW. This reception requires 1.2 seconds corresponding to a time period required for transmitting 60-bit information containing both a telemetry word (TLM) containing the preamble and HOW. Even if the reception of a parity at the HOW end is omitted in order to reduce this time period, the reception requires at least 0.94 seconds corresponding to a time period required for transmitting 47-bit information, and further reduction is difficult.

The present invention has been made in view of the above-mentioned circumstances, and has an object to reduce the reception time period required for time adjustment in the satellite radio-controlled wristwatch.

Solution to Problem

The invention disclosed in this application to achieve the above-mentioned object has various aspects, and the representative aspects are outlined as follows.

(1) A satellite radio-controlled wristwatch, including: a satellite radio wave reception unit including an antenna for receiving a satellite radio wave, a high frequency circuit, and a decoder circuit; a clock circuit for holding and counting an internal time; and a controller for controlling a timing of at least a time information acquisition operation of acquiring time information from the satellite radio wave received by the satellite radio wave reception unit, the controller being configured to selectively execute, in the time information acquisition operation, based on error evaluation of the internal time: a shortened time adjustment operation of ending the time information acquisition operation at a stage at which head information representing a head of unit information is received, and adjusting the internal time based on a timing at which the head information is received; and a normal time adjustment operation of receiving the time information, and adjusting the internal time based on the time information.

(2) The satellite radio-controlled wristwatch according to Item (1), in which, in the shortened time adjustment operation, the controller executes the normal time adjustment operation when an adjustment amount of the internal time is equal to or more than a predetermined value.

(3) The satellite radio-controlled wristwatch according to Item (1) or (2), in which, in the normal time adjustment operation, the controller receives the time information again when an adjustment amount of the internal time is equal to or more than a predetermined value or when an index representing a reception intensity of the received satellite radio wave is equal to or less than a predetermined value, and adjusts the internal time when the time information received again matches with the time information received previously.

(4) The satellite radio-controlled wristwatch according to any one of Items (1) to (3), in which the clock circuit holds information relating to a date, and, in the shortened time adjustment operation, the controller updates the information relating to the date when a time point at which the head information is received is within a predetermined range from a time point at which the information relating to the date is updated in the internal time, and when the information relating to the date has not been updated at a time point at which the internal time is adjusted.

(5) The satellite radio-controlled wristwatch according to any one of Items (1) to (3), in which the clock circuit holds information relating to a date, and, in the shortened time adjustment operation, the controller inhibits the shortened time adjustment operation when a time point at which the head information is received is within a predetermined range from a time point at which the information relating to the date is updated in the internal time.

Advantageous Effects of Invention

According to the aspect of Item (1) or (2), in the satellite radio-controlled wristwatch, it is possible to reduce the reception time period required for time adjustment, and to prevent erroneous adjustment to be caused due to reduction of the reception time period.

Further, according to the aspect of Item (3), it is possible to prevent the erroneous adjustment also when the reception intensity of the satellite radio wave is weak.

Further, according to the aspect of Item (4) or (5), in the satellite radio-controlled wristwatch, it is possible to prevent erroneous adjustment of the information relating to the date to be caused due to the reduction of the reception time period required for the time adjustment.

BRIEF DESCRIPTION OF DRAWINGS

FIG. 4 is a table showing the structure of subframe 1.

DESCRIPTION OF EMBODIMENTS

Figure 1:
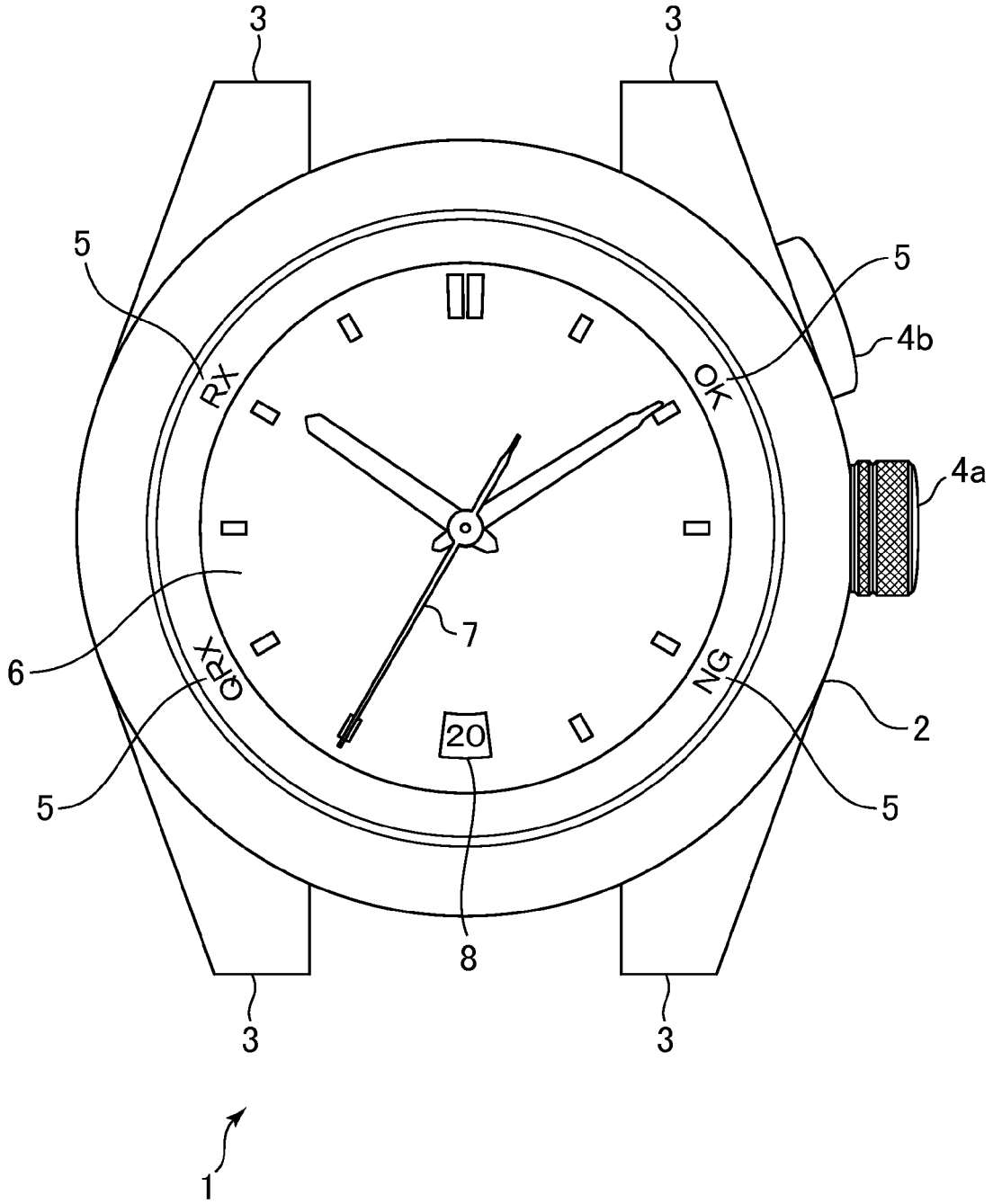
FIG. 1 is a plan view illustrating a satellite radio-controlled wristwatch according to an embodiment of the present invention.

FIG. 1 is a plan view illustrating a satellite radio-controlled wristwatch 1 according to an embodiment of the present invention. As described above, the satellite radio-controlled wristwatch as used herein refers to one type of radio-controlled wristwatches that are wristwatches having a function of receiving an external radio wave to adjust the time held inside the watch to an accurate time, which is configured to receive a satellite radio wave to adjust the time. Note that, the satellite radio-controlled wristwatch 1 according to this embodiment receives a radio wave (L1 wave) from a GPS satellite as the satellite radio wave.

In FIG. 1, reference numeral 2 denotes an exterior case, and band attachment portions 3 are provided to be opposed in the 12 o'clock direction and the 6 o'clock direction. Further, a crown 4*a* and a push button 4*b* serving as operating members are provided on a side surface of the satellite radio-controlled wristwatch 1 on the 3 o'clock side. Note that, in FIG. 1, the 12 o'clock direction of the satellite radio-controlled wristwatch 1 is an upward direction of FIG. 1, and the 6 o'clock direction is a downward direction of FIG. 1.

The satellite radio-controlled wristwatch 1 uses a hand mechanism as illustrated in FIG. 1, in which an hour hand, a minute hand, and a second hand are coaxially provided, with the central position of the satellite radio-controlled wristwatch 1 as the rotation center. Note that, although the second hand in this embodiment is coaxial with the hour and minute hands, the second hand may be replaced with a so-called chronograph hand and the second hand may be arranged at an arbitrary position as a secondary hand as exemplified by a chronograph watch. Then, position indications 5 of symbols "OK", "NG", "QRX", and "RX" are marked or printed on the exterior case 2 at appropriate positions outside a watch face 6. Those characters notify the user of various reception states of the satellite radio-controlled wristwatch 1 by causing the second hand to rotate and move to point to any one of those position indications 5 during or around the reception of the satellite radio wave by the satellite radio-controlled wristwatch 1. Therefore, the secondhand is also a reception indication member 7 for indicating, to the user, various reception states of the satellite radio-controlled wristwatch 1. Note that, the respective position indications 5 herein have the following meanings. That is, symbols "QRX" and "RX" mean that reception is in progress, symbol "OK" means that the reception has succeeded, and symbol "NG" means that the reception has failed. Note that, in this embodiment, there are two kinds of indications, "QRX" and "RX", for indicating that the reception is in progress because the satellite radio-controlled wristwatch 1 carries out some kinds of reception operations. Among them, in particular, symbol "QRX" represents that a reception operation of ending the reception operation in a short period of time is in progress, while symbol "QX" represents that another reception operation is in progress. When the reception indication member 7 is indicating symbol "QRX", the user can know that the satellite radio-controlled wristwatch 1 is carrying out an operation placing priority on short-time reception. Further, when the reception indication member 7 is indicating symbol "RX", the user can know that the satellite radio-controlled wristwatch 1 is carrying out an operation placing priority on reception success probability. Various reception operations to be executed by the satellite radio-controlled wristwatch 1 are described later.

Further, a date window 8 is provided at the 6 o'clock position of the watch face 6, and date can be visually recognized based on a position of a day dial shown through the date window 8. Note that, the date window 8 is merely an example and date display by an appropriate mechanism may be provided at an appropriate position. For example, in addition to the date display using the day dial or another rotating disk, day-of-week display and various kinds of indication using a secondary hand may be used. Alternatively, display by an electronic display device such as a liquid crystal display device may be used. In any case, the satellite radio-controlled wristwatch 1 internally holds at least information on the current date as well as the current time.

The satellite radio-controlled wristwatch 1 according to this embodiment further includes a patch antenna serving as a high frequency receiving antenna on the rear side of the watch face 6 at a position on the 9 o'clock side. Note that, the form of the antenna may be determined in accordance with the radio wave to be received, and an antenna of another form such as an inverted-F antenna may be used.

Figure 2:
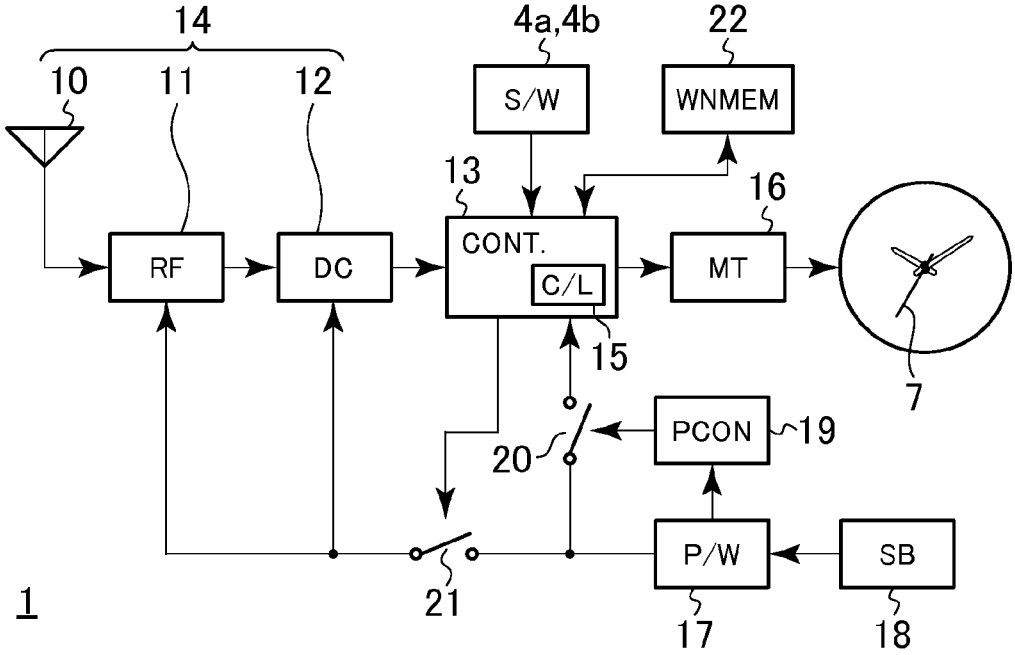
FIG. 2 is a functional block diagram of the satellite radio-controlled wristwatch according to the embodiment of the present invention.

FIG. 2 is a functional block diagram of the satellite radio-controlled wristwatch 1 according to this embodiment. A satellite radio wave is received by an antenna 10 and converted into a base band signal by a high frequency circuit 11.

After that, various kinds of information contained in the satellite radio wave is extracted by a decoder circuit 12. The extracted information is transferred to a controller 13. In this case, the antenna 10, the high frequency circuit 11, and the decoder circuit 12 construct a satellite radio wave reception unit 14 for receiving a satellite radio wave and extracting information. The satellite radio wave reception unit 14 receives the satellite radio wave that is an ultra-high frequency wave and extracts the information, and hence operates at a high frequency.

The controller 13 is a microcomputer for controlling the entire operation of the satellite radio-controlled wristwatch 1, and includes a clock circuit 15 therein, thereby having a function of counting the internal time, which is the time held by the clock circuit 15. The accuracy of the clock circuit 15 is about ±15 seconds per month although varying depending on the accuracy of a crystal oscillator to be used or the use environment such as temperature. It should be understood that the accuracy of the clock circuit 15 can be set arbitrarily as necessary. Further, the controller 13 appropriately adjusts the internal time held by the clock circuit 15 as necessary, to thereby keep the internal time accurate. The controller 13 is only required to have a response speed necessary for responding to counting and a user's operation. Therefore, the controller 13 operates at a lower frequency than that of the above-mentioned satellite radio wave reception unit 14, and hence its power consumption is small.

Further, the controller 13 can communicate to/from a date information storage unit 22 for storing date information that is information relating to the current date. The date information herein refers to information other than time information (that is, hour, minute, and second) and is information for specifying the date on a calendar. In the case of the GPS, WN described later corresponds to the date information. Therefore, the date information storage unit 22 stores received WN. Incidentally, the date information is information required to be updated along with the elapse of time. For example, when the date information is WN as in this embodiment, WN is incremented by 1 at a time point at which 0:00 AM arrives on Sunday in GPS time, and when the date information is a date, the date is required to be updated at a time point at which 0:00 AM arrives every day. In view of this, when the internal time counted by the clock circuit 15 arrives to a time point at which the date information is required to be updated, the controller 13 updates the date information stored in the date information storage unit 22. Therefore, when the time counted by the clock circuit 15 is accurate, it is known that the date information storage unit 22 stores accurate date information (in this case, WN) even without receiving the date information. Note that, the date information stored in the date information storage unit 22 may be updated directly by the clock circuit 15. The date information storage unit 22 may be an arbitrary information storage element such as a semiconductor memory, but is preferred to be a non-volatile memory such as an electrically erasable programmable read-only memory (EEPROM) or a flash memory.

The controller 13 inputs a signal from the operating member (crown 4*a*, push button 4*b*, or the like) so that the operation by the user can be detected. Further, the controller 13 outputs a signal for driving a motor 16 based on the internal time, to thereby drive the hands to indicate the time. Further, necessary indication is given to the user by the reception indication member 7. Note that, in this embodiment, the reception indication member 7 is the second hand, but the present invention is not limited thereto. Another hand or another member such as a disk may be used. For example, a dedicated hand for indication of various functions may be used as the reception indication member. Alternatively, the respective hands may be independently driven so as to drive a plurality of hands, for example, the hour hand and the minute hand in an overlapped manner, thereby using the hands as the reception indication member. Still alternatively, the motion speed and the motion mode (intermittent drive, movement of the second hand at two-second intervals, or the like) of a hand may differ from those in normal hand motion, to thereby use the hand as the reception indication member. Further, an electronic display member such as a liquid crystal display device may be used as the reception indication member.

The satellite radio-controlled wristwatch 1 further includes, as its power supply, a battery 17 that is a secondary battery such as a lithium-ion battery. The battery 17 accumulates electric power obtained by power generation of a solar battery 18 arranged on or under the watch face 6 (see FIG. 1). Then, the battery 17 supplies electric power to the high frequency circuit 11, the decoder circuit 12, and the controller 13.

A power supply circuit 19 monitors an output voltage of the battery 17. When the output voltage of the battery 17 decreases to be lower than a predetermined threshold, the power supply circuit 19 turns off a switch 20 to stop the supply of power to the controller 13. In response thereto, the supply of power to the clock circuit 15 is also stopped. Thus, when the switch 20 is turned off, the internal time held by the clock circuit 15 is lost. Further, when the output voltage of the battery 17 is recovered due to the power generation of the solar battery 18 or the like, the power supply circuit 19 turns on the switch 20 to supply power to the controller 13, to thereby recover the functions of the satellite radio-controlled wristwatch 1. Further, a switch 21 is a switch for turning on or off the supply of power to the high frequency circuit 11 and the decoder circuit 12, and is controlled by the controller 13. The high frequency circuit 11 and the decoder circuit 12, which operate at a high frequency, are large in power consumption, and hence the controller 13 turns on the switch 21 to operate the high frequency circuit 11 and the decoder circuit 12 only when the radio wave is received from the satellite, and otherwise turns off the switch 21 to reduce power consumption.

The satellite radio wave may be received when a request is issued from a user through operation of the operating member such as the crown 4*a* or the push button 4*b* (hereinafter referred to as "manual reception"), or when a predetermined time has come (hereinafter referred to as "regular reception"). Alternatively, the satellite radio wave may be received based on an elapsed time from the time at which the previous time adjustment was made, or based on information representing the generated energy of the solar battery 18 or other information representing an ambient environment of the satellite radio-controlled wristwatch 1 (hereinafter referred to as "environmental reception"). Note that, as a term opposed to "manual reception", the regular reception and the environmental reception are collectively referred to as "automatic reception".

Subsequently, a description is given of a signal from a GPS satellite received by the satellite radio-controlled wristwatch 1 according to this embodiment. The signal transmitted from the GPS satellite has a carrier frequency of 1,575.42 MHz called "$L_1$ band". The signal is encoded by a C/A code specific to each GPS satellite modulated by binary phase shift keying (BPSK) at a period of 1.023 MHz, and is multiplexed by a so-called code division multiple access (CDMA) method. The C/A code itself has a 1,023-bit length, and message data on the signal changes every 20 C/A codes. In other words, 1-bit information is transmitted as a signal of 20 ms.

Figure 3:
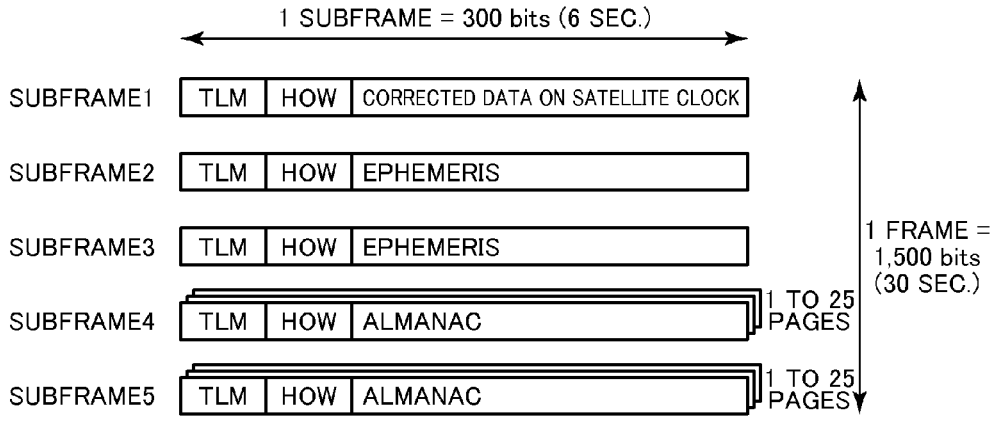
FIG. 3 is a schematic diagram illustrating the structure of subframes of a signal transmitted from a GPS satellite.

The signal transmitted from the GPS satellite is divided into frames having a unit of 1,500 bits, namely 30 seconds, and each frame is further divided into five subframes. FIG. 3 is a schematic diagram illustrating the structure of subframes of the signal transmitted from the GPS satellite. Each subframe is a signal of seconds containing 300-bit information. The subframes are numbered 1 to 5 in order. The GPS satellite transmits the subframes sequentially starting from subframe 1. When finishing the transmission of subframe 5, the GPS satellite returns to the transmission of subframe 1 again, and repeats the same process thereafter.

At the head of each subframe, a telemetry word represented by TLM is transmitted. TLM contains a preamble that is a code indicating the head of each subframe, and information on a ground control station. Subsequently, a handover word represented by HOW is transmitted. HOW contains TOW as information relating to the current time, also called "Z count". TOW is a 6-second-unit time counted from 0:00 AM on Sunday at GPS time, and indicates a time at which the next subframe is started.

Information following HOW differs depending on the subframe, and subframe 1 includes corrected data of a satellite clock. FIG. 4 is a table showing the structure of subframe 1. Subframe 1 includes a week number represented by WN following HOW. WN is a numerical value indicating a current week counted by assuming Jan. 6, 1980 as a week 0. Accordingly, by receiving both WN and TOW, accurate day and time at the GPS time can be obtained. Note that, once the reception of WN is succeeded, an accurate value can be known through counting of the internal time unless the satellite radio-controlled wristwatch 1 loses the internal time for some reason, for example, running out of the battery. Therefore, when WN is stored in the date information storage unit 22 as in this embodiment, re-reception is not always necessary. Note that, as described above, WN is 10-bit information and hence is returned to 0 again when 1,024 weeks has elapsed. Further, the signal from the GPS satellite contains other various kinds of information, but information not directly relating to the present invention is merely shown and its description is omitted.

Referring to FIG. 3 again, subframe 2 and subframe 3 contain orbit information on each satellite called "ephemeris" following HOW, but its description is herein omitted.

In addition, subframes 4 and 5 contain general orbit information for all the GPS satellites called "almanac" following HOW. The information contained in subframes 4 and 5, which has a large information volume, is transmitted after being divided into units called "pages". Then, the data to be transmitted in each of subframes 4 and 5 is divided into pages 1 to 25, and contents of the pages that differ depending on the frames are transmitted in order. Accordingly, 25 frames, that is, 12.5 minutes is required to transmit the contents of all the pages.

Note that, as is apparent from the above description, TOW is contained in all the subframes and can therefore be acquired at a timing that arrives every 6 seconds. On the other hand, WN is contained in subframe 1 and can therefore be acquired at a timing that arrives every 30 seconds.

Figure 5:
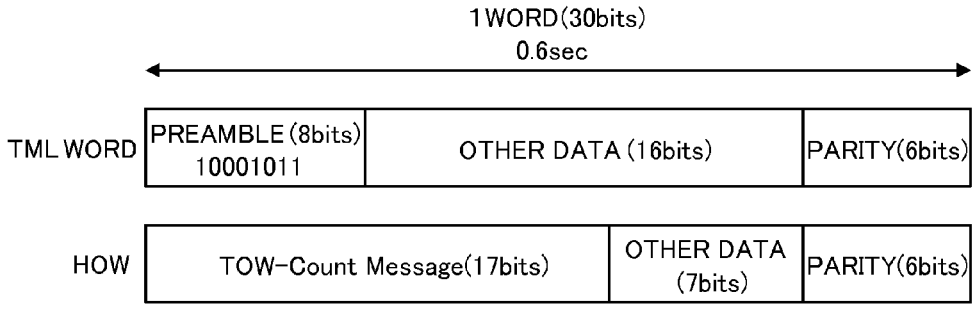
FIG. 5 is a view illustrating structures of TLM and HOW.

Further, with reference to FIG. 5, the data structures of TLM and HOW are described. FIG. 5 is a view illustrating the structures of TLM and HOW. Each of TLM and HOW is formed of a 30-bit data string called 1 word, and the time required for transmission of each of TLM and HOW is 30 bits×20 ms=0.6 seconds.

TLM contains, at the head, a preamble that is data of a fixed value representing the head of each subframe, and its value is always "10001011". Therefore, when the decoder circuit 12 (or the controller 13) detects this data string, it is known that the transmission start time point was the head of the subframe. Therefore, the preamble is head information representing the head of the subframe that is unit information. The reception of the preamble requires 8 bits×20 ms=0.16 seconds. The remaining data of TLM is 16-bit other data (that is information on a ground control station) and a 6-bit parity for error detection.

Subsequent HOW contains, at the head, 17-bit TOW. The information amount of the total data from the head of the preamble to TOW is 47 bits, and as described above, this reception requires 47 bits×20 ms=0.94 seconds. The remaining data of HOW is 7-bit other data and a parity. The reception of TML and HOW containing the parity requires 1.2 seconds.

Subsequently, individual operations executed when the satellite radio-controlled wristwatch 1 receives a satellite radio wave are described below with reference to FIGS. 1 and 2. The controller 13 executes a reception operation that is a series of operations of receiving the satellite radio wave by the satellite radio-controlled wristwatch 1 while controlling the timings of those individual operations.

(1) Continuous Operation Detection Operation

A continuous operation detection operation is an operation of detecting that the operating member has operated continuously for a predetermined operation reception time period. In the case of this embodiment, when the user carries out a long press operation of continuously pressing the push button 4*b* for a predetermined time period (for example, 2 seconds, hereinafter referred to as "operation reception time period"), the manual reception is carried out. Continuous operation is required for the user so as to prevent unintended operation due to an operation error. The continuous operation detection operation is carried out by the controller 13 by detecting that the push button 4*b* has been pressed, and then detecting that the pressing has been continued for a predetermined time period. Further, the continuous operation detection operation is an operation for accepting the reception instruction of the satellite radio wave by the user. In this embodiment, the controller 13 waits for the completion of this continuous operation detection operation, and then detects that the reception instruction is issued. That is, the reception instruction is detected at a timing at which the state of pressing the push button 4*b* is continued for the above-mentioned operation reception time period.

(2) Activation Operation

An activation operation is an operation of turning on the switch 21 to supply power to the satellite radio wave reception unit 14 for activation thereof. This operation includes initialization of the high frequency circuit 11 and the decoder circuit 12 or the like, and takes a little time. The time point for ending the activation operation may be a time point at which a predetermined time period (for example, 0.6 seconds) has elapsed from the turning on of the switch 21 by the controller 13, or a time point at which the controller 13 has received a signal representing an activation end from the high frequency circuit 11 and the decoder circuit 12. A time period required for the activation operation is hereinafter referred to as "activation time period".

(3) Acquisition and Tracking Operation

An acquisition and tracking operation is an operation of acquiring and tracking a certain satellite radio wave by the satellite radio wave reception unit 14. The term. "acquisition" herein refers to an operation of extracting one of the signals multiplexed by CDMA, specifically, an operation of multiplying a received signal by a C/A code corresponding to one signal to extract a correlated signal. When a correlated signal cannot be obtained by the selected C/A code, a different C/A code is selected again to repeat the operation. At this time, when there are a plurality of correlated signals, a signal having the highest correlation may be selected. Further, satellite position information may be used to predict the satellite radio waves that may be received, to thereby limit the number of C/A codes to be selected and reduce the time required for the acquisition operation. Further, the term "tracking" herein refers to an operation of continuously extracting data by matching the phase of the carrier wave of the received signal and the phase of the C/A code contained in the received signal with the phase of the carrier wave of the selected C/A code and the phase of the code for decoding. Note that, it can be said from the meaning of the term "tracking" that the "tracking" is carried out while data is extracted from the satellite radio wave, but the "acquisition and tracking operation" herein refers to an operation from the start of acquiring the satellite radio wave to the head of TLM. This acquisition and tracking operation requires a time period of approximately 2 seconds. The time period required for the acquisition and tracking operation is hereinafter referred to as "acquisition and tracking time period".

(4) Time Information Acquisition Operation

A time information acquisition operation is an operation of acquiring information for knowing the time at the current time point from the satellite radio wave received by the satellite radio wave reception unit 14. In this case, the information for knowing the time at the current time point primarily refers to TOW that is the time information. However, in the GPS navigation message that is the satellite radio wave to be received in this embodiment, it is possible to know the accurate start time point of transmission of each subframe. In view of this point, the preamble may also be the information for knowing the time at the current time point. Note that, the preamble itself is fixed data, and does not represent a count value from 0:00 AM on Sunday in GPS time unlike TOW. Therefore, what can be known by the preamble is the transmission timing of the subframe that arrives every 6 seconds.

Therefore, the time information acquisition operation in this embodiment is an operation of receiving only the preamble or the preamble and TOW. In the former case, the time information acquisition operation is ended by the controller 13 at a time point at which the preamble is received, which requires 0.16 seconds as described above. In the latter case, an operating of receiving TLM and HOW to acquire TOW contained in HOW corresponds to the time information acquisition operation, which requires 0.94 seconds in the shortest as described above and 1.2 seconds when the parity is received.

(5) Date Information Acquisition Operation

A date information acquisition operation is an operation of acquiring date information from the satellite radio wave received by the satellite radio wave reception unit 14. In this embodiment, an operation of receiving WN transmitted after TLM and HOW to acquire WN corresponds to the date information acquisition operation. Note that, TOW contained in HOW can be simultaneously acquired at this time. Therefore, in this embodiment, the date information acquisition operation also serves as the time information acquisition operation.

(6) Internal Time Adjustment Operation

An internal time adjustment operation is an operation of overwriting the internal time held in the clock circuit 15 to adjust the internal time. The controller 13 adjusts the internal time held in the clock circuit 15 based on the timing at which the preamble is received when the preamble is received or based on the values of received TOW and the timing at which TOW is received when TOW is received.

There are various kinds of adjustment methods. For example, after the preamble or the time information is acquired, the last second may be shortened or extended so that the beginning of the second of the internal time that first arrives matches with an accurate timing. Alternatively, the internal time may be rewritten so that the internal time counts a second at a timing of a beginning of the second that arrives after the preamble or the time information is acquired. Still alternatively, an accurate time at a time point at which the preamble or the time information is acquired may be calculated, and the internal time may be immediately rewritten. In this embodiment, the first mode is adopted, that is, the last second is shortened or extended so that the beginning of the second of the internal time that first arrives after the preamble or the time information is acquired matches with an accurate timing.

(7) Reception Indication Operation

A reception indication operation is an operation of indicating that the reception operation is in progress by the reception indication member 7. In the case of this embodiment, the reception indication operation includes two kinds of indications described later, specifically, indication representing that the first reception operation is in progress ("QRX") and indication representing that another reception operation is in progress ("RX").

(8) Reception Result Indication Operation

A reception result indication operation is an operation of indicating the reception result by the reception indication member 7. The reception result as used herein refers to any one of a case where the reception has succeeded and the internal time is adjusted (corresponding to "OK" indication) and a case where the reception has failed and the internal time is not adjusted (corresponding to "NG" indication).

(9) Previous Reception Result Indication Operation

A previous reception result indication operation is an operation of indicating the previous reception result by the reception indication member 7. The previous reception result as used herein refers to any one of a case where the previous reception has succeeded and the internal time has been adjusted (corresponding to "OK" indication) and a case where the previous reception has failed and the internal time has not been adjusted (corresponding to "NG" indication).

The controller 13 executes the above-mentioned respective operations while controlling the timings of the respective operations depending on the conditions when the reception instruction is detected.

By the way, as described above, in the time information acquisition operation in this embodiment, the preamble or TOW is received as the time information, and what can be known by the preamble is only the transmission timing of the subframe that arrives every 6 seconds. Therefore, the adjustment of the internal time when the preamble is received is adjustment of matching any one of the timings that arrive every 6 seconds in the internal time to the timing obtained through the reception. Therefore, when there is a large error between the internal time and the accurate time, the internal time may be erroneously adjusted to a timing different from a proper timing to be adjusted. In view of this, the controller 13 is configured to evaluate the error of the internal time, consider the error evaluation and other conditions, and select and execute various reception operations described below depending on the result. Note that, typical reception operations are only exemplified here, and further other reception operations may be added and executed without problem.

<Shortened Time Adjustment Operation>

A shortened time adjustment operation is a reception operation of receiving the preamble to adjust the time. In the shortened time adjustment operation, the controller 13 ends the time information acquisition operation at a stage at which the preamble corresponding to the head information is received, and adjusts the internal time based on the timing at which the preamble is received.

Figure 6A:
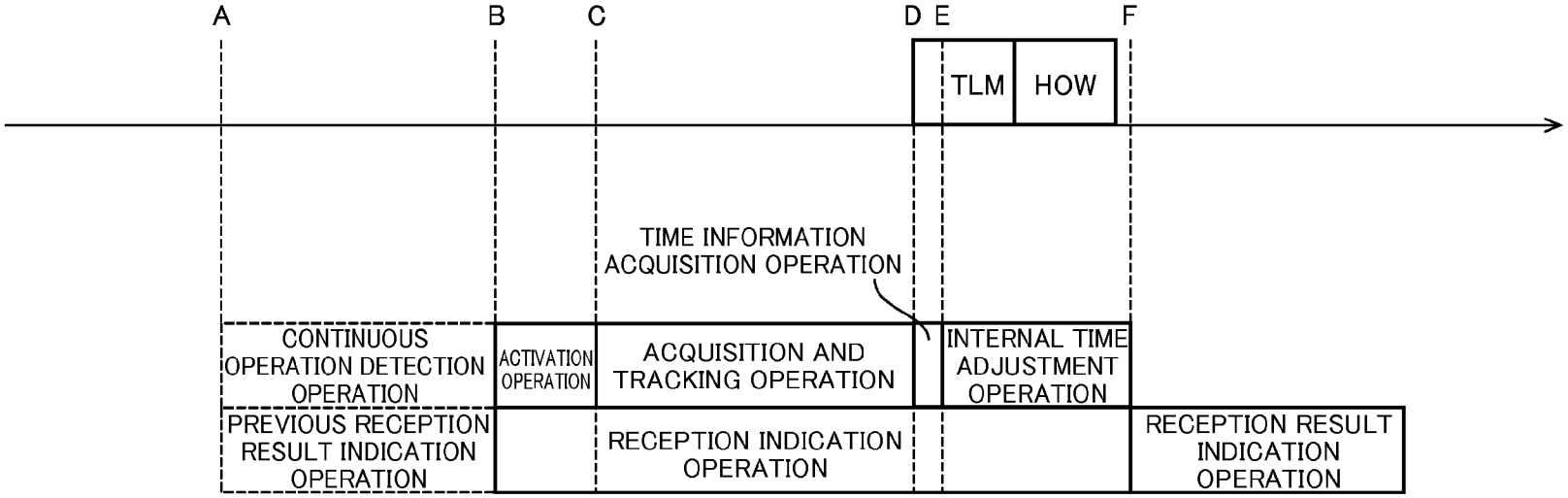
FIG. 6A is a time chart illustrating a shortened time adjustment operation.

FIG. 6A is a time chart illustrating the shortened time adjustment operation. In the chart, the horizontal axis represents the elapse of time. The shortened time adjustment operation is a reception operation that is executed when the error is evaluated to be small as a result of the error evaluation of the internal time.

First, prior to the shortened time adjustment operation, at a time point A at which the push button 4*b* is pressed, the controller 13 starts the continuous operation detection operation to detect whether or not the push button 4*b* is continuously operated for the operation reception time period, and simultaneously starts the previous reception result indication operation to cause the reception indication member 7 to indicate the previous reception result. Then, the reception instruction is accepted at a time point B at which the continuous operation detection operation is completed after the push button 4*b* is continuously pressed for the operation reception time period. The controller 13 determines the reception operation to be executed based on the error evaluation and other conditions at the time point B at which the reception instruction is accepted. It is here assumed that the shortened time adjustment operation is selected.

In the shortened time adjustment operation, at the time point B, the controller 13 immediately starts the activation operation to supply power to the satellite radio wave reception unit 14, and also starts the reception indication operation to cause the reception indication member 7 to indicate that the reception is in progress. At this time, in order to notify the user that the shortened time adjustment operation is in progress, the second hand serving as the reception indication member 7 points to symbol "QRX". Further, at a time point C at which the activation operation is ended, the controller 13 immediately starts the acquisition and tracking operation.

The controller 13 continues the acquisition and tracking operation until a transmission timing D of a subframe, and starts the time information acquisition operation at the transmission timing D. Then, at a time point E at which the preamble positioned at the TLM head is received, the controller 13 ends the time information acquisition operation.

After that, the controller 13 starts the internal time adjustment operation. With this, the internal time is rewritten so that the beginning of the second matches with a time point of the beginning of the second at an accurate timing, which first arrives after the time point E. As the value of the internal time at this time, the timing at every 6 seconds that is closest to the internal time before rewriting at the rewriting timing is selected. Therefore, in the shortened time adjustment operation, the time is accurately adjusted when the error of the internal time is less than ±3 seconds, but the time is erroneously adjusted in a 6-second unit when the error of the internal time is equal to or more than ±3 seconds. Note that, when the error of the internal time calculated at this time is equal to or more than a certain value, for example, 1 second, the shortened time adjustment operation may be stopped because there is a possibility of erroneous adjustment, and a normal time adjustment operation described next may be carried out. This algorithm is described later.

The controller 13 starts the reception result indication operation at a time point F at which the internal time adjustment operation is ended. When the reception has succeeded, the controller 13 causes the reception indication member 7 (in this embodiment, the second hand) to point to the "OK" position indication 5. Note that, the reception result indication operation may start at the time point E without waiting for the transfer of the time information.

<Normal Time Adjustment Operation>

A normal time adjustment operation is a reception operation of receiving TOW corresponding to the time information to adjust the time. In the normal time adjustment operation, the controller 13 receives TOW, and adjusts the internal time based on received TOW.

Figure 6B:
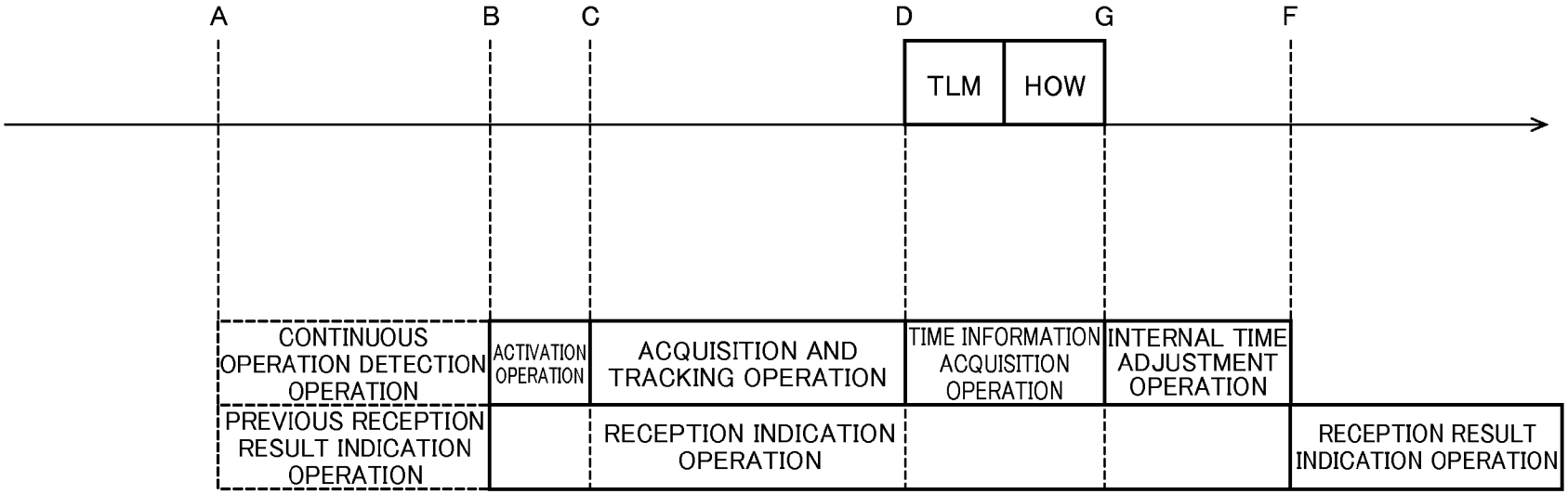
FIG. 6B is a time chart illustrating a normal time adjustment operation.

FIG. 6B is a time chart illustrating the normal time adjustment operation. Also in this chart, the horizontal axis represents the elapse of time. The normal time adjustment operation is a reception operation that is executed when the error is evaluated to be large and other conditions are satisfied as a result of the error evaluation of the internal time.

Similarly to the case of the shortened time adjustment operation, prior to the normal time adjustment operation, at the time point A at which the push button 4*b* is pressed, the controller 13 starts the continuous operation detection operation and the previous reception result indication operation simultaneously. Then, depending on the error evaluation and other conditions at the time point B at which the reception instruction is accepted, it is assumed here that the controller 13 selects the normal time adjustment operation.

Note that, FIG. 6B illustrates the reception operation of the case of the manual reception, and hence the continuous operation detection operation and the previous reception result indication operation are illustrated. In the case of the automatic reception, however, those two operations are not executed. In the case of the automatic reception, the timing at which the controller determines to carry out the automatic reception corresponds to the time point B.

Also in the normal time adjustment operation, at the time point B, the controller 13 immediately starts the activation operation to supply power to the satellite radio wave reception unit 14, and starts the reception indication operation to cause the reception indication member 7 to indicate that the reception is in progress. In this case, in order to notify the user that the normal time adjustment operation is in progress, the second hand serving as the reception indication member 7 points to symbol "RX". Further, at the time point C at which the activation operation is ended, the controller 13 immediately starts the acquisition and tracking operation.

The controller 13 continues the acquisition and tracking operation until the transmission timing D of the subframe, and starts the time information acquisition operation at the transmission timing D. In this case, TLM and HOW are received to acquire the value of TOW contained in HOW.

After that, the controller 13 starts the internal time adjustment operation from a time point G at which the transmission of HOW is ended, and similarly to the case of the shortened time adjustment operation, rewrites the internal time so that the beginning of the second matches with a time point of the beginning of the second at an accurate timing, which first arrives after the time point G. A value converted from TOW is used as the value of the internal time at this time. Therefore, in the normal time adjustment operation, as long as TOW is obtained accurately, the erroneous adjustment of the internal time does not occur.

The controller 13 starts the reception result indication operation at the time point F at which the internal time adjustment operation is ended. When the reception has succeeded, the controller 13 causes the reception indication member 7 (in this embodiment, second hand) to point to the "OK" position indication 5. Note that, the reception result indication operation may be started at the time point G without waiting for the transfer of the time information.

Note that, in the normal time adjustment operation, determination may be made on whether or not the reception result is reliable when the reception has succeeded, and TOW may be received again when the reliability is considered to be low. This algorithm is described later.

<Date Information Reception Operation>

A date information reception operation is executed when acquisition of WN is necessary. The acquisition of WN may be executed when the clock circuit 15 stops due to the decrease of a power supply voltage of the satellite radio-controlled wristwatch 1, or when a predetermined period (for example, 1 month) has elapsed from the previous WN reception.

Figure 6C:
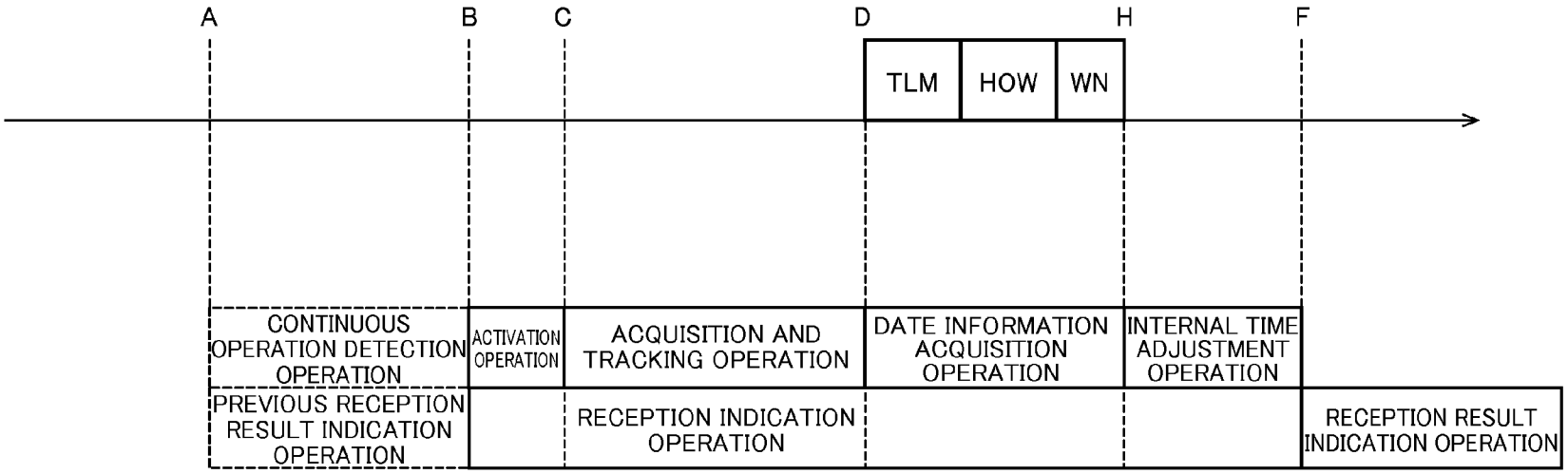
FIG. 6C is a time chart illustrating a date information reception operation.

FIG. 6C is a time chart illustrating the date information reception operation. Also in this chart, the horizontal axis represents the elapse of time. The operations in the date information reception operation are similar to those in the normal time adjustment operation described above. The point that, in the case of the automatic reception, the continuous operation detection operation and the previous reception result indication operation illustrated in FIG. 6C are not executed, and the operation starts from the time point B is also the same.

Also in the date information reception operation, at the time point B at which the reception instruction is accepted, the controller 13 immediately starts the activation operation to supply power to the satellite radio wave reception unit 14, and starts the reception indication operation. At this time, the reception indication member 7 points to symbol "RX". Further, at the time point C at which the activation operation is ended, the controller 13 immediately starts the acquisition and tracking operation.

Further, the controller 13 continues the acquisition and tracking operation until the transmission timing D of the subframe, and starts the date information acquisition operation at the transmission timing D. In this case, TLM, HOW, and subsequent WN are received. At this time, TOW contained in HOW is simultaneously acquired.

After that, the controller 13 starts the internal time adjustment operation from a time point H at which the transmission of WN is ended, and similarly to the case of the normal time adjustment operation, rewrites the internal time so that the beginning of the second matches with a time point of the beginning of the second at an accurate timing, which first arrives after the time point H. Further, based on received WN, the value of WN stored in the date information storage unit 22 is updated.

The controller 13 starts the reception result indication operation at the time point F at which the internal time adjustment operation is ended. When the reception has succeeded, the controller 13 causes the reception indication member 7 (in this embodiment, the second hand) to point to the "OK" position indication 5. Note that, the reception result indication operation may be started at the time point H without waiting for the transfer of the time information.

Note that, as described above, WN is only transmitted every 30 seconds. Therefore, in the operation illustrated in FIG. 6C, the time spent for the acquisition and tracking operation may be long, which may cause a problem of increase in power consumption. In such a case, the transmission timing D of subframe 1 at which WN is transmitted may be predicted based on the internal time, and the activation operation may be delayed until a time point at which the activation operation and the acquisition and tracking operation meet the transmission timing D. In this case, the timing to start the activation operation is a time point obtained by subtracting the activation time period and the acquisition and tracking time period from the predicted transmission timing D.

Figure 7:
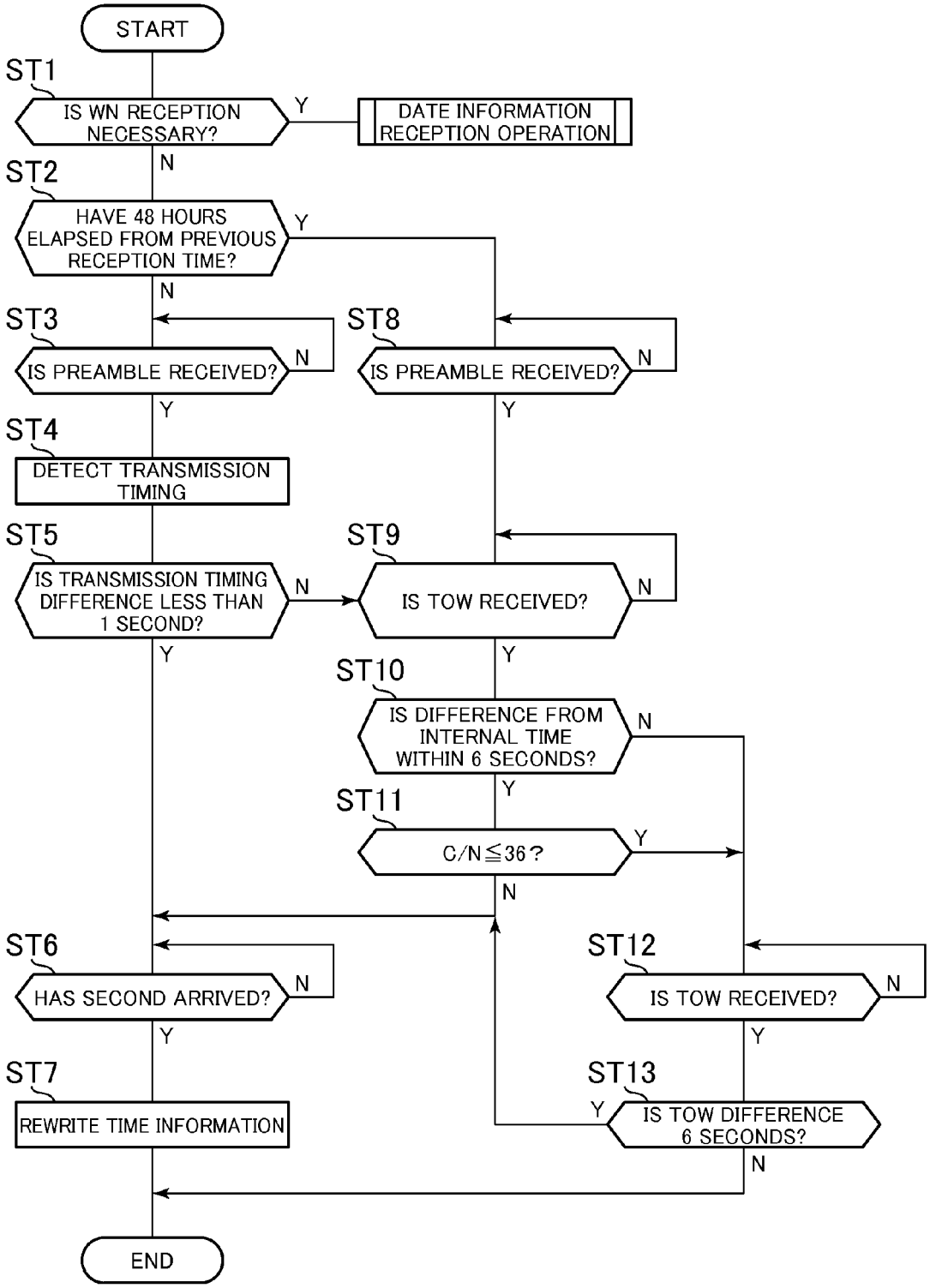
FIG. 7 is a flow chart illustrating an operation relating to reception of the satellite radio-controlled wristwatch according to the embodiment of the present invention.

FIG. 7 is a flow chart illustrating an operation relating to the reception of the satellite radio-controlled wristwatch 1 according to this embodiment. This flow chart represents conditions for the controller 13 to select the shortened time adjustment operation, the normal time adjustment operation, or the date information reception operation.

The controller 13 first determines whether or not the reception of WN is necessary (Step ST1). When the reception of WN is necessary, the above-mentioned date information reception operation is selected.

Otherwise, in subsequent Step ST2, the controller 13 carries out error evaluation of the internal time. In this case, as an example, determination is made on whether or not 48 hours have elapsed from the time adjustment based on the previous reception. This determination is equivalent to the determination of, in a case where the accuracy of the clock circuit 15 is, for example, ±15 seconds per month, whether or not the error is equal to or less than 1 second when the maximum error is estimated. As a matter of course, this determination condition may be appropriately changed depending on the accuracy of the clock circuit 15. When this condition is satisfied, the controller 13 selects the normal time adjustment operation to proceed to Step ST8, and otherwise selects the shortened time adjustment operation to proceed to Step ST3. Note that, although not illustrated in the flow, before Step ST3 and Step ST8 are executed, the controller 13 executes the activation operation, the acquisition and tracking operation, and the reception indication operation.

In Step ST3, the process enters the time information acquisition operation. The controller 13 waits for the reception of the preamble. When the preamble is received, in Step ST4, the controller 13 detects the preamble transmission timing that arrives every 6 seconds. After that, in Step ST5, the controller 13 compares a preamble transmission timing that is predicted based on the internal time with the actual preamble transmission timing obtained through the reception, and determines whether or not the difference therebetween is less than 1 second. When this determination result is NO, the controller 13 proceeds to Step ST9 to switch the reception operation to the normal time adjustment operation. Otherwise, the controller 13 proceeds to the internal time adjustment operation, and waits for arrival of the timing of the second in Step ST6 to rewrite the time information in Step ST7.

On the other hand, when the normal time adjustment operation is selected in Step ST2, the time information acquisition operation in the normal time adjustment operation is carried out in Step ST8 and Step ST9. First, in Step ST8, the controller 13 waits for the reception of the preamble, proceeds to Step ST9 when the preamble is received, and waits for the reception of TOW. When TOW is received, in subsequent Steps ST10 and ST11, the reliability of the received time information is evaluated. That is, in Step ST10, the controller 13 evaluates the difference between the received time information and the internal time, and determines whether or not this difference is within 6 seconds. In this step, it is determined that there is a possibility of erroneous reception when the difference between the reception result and the internal time is too large. Note that, the threshold value of 6 seconds represented here is merely an example, and an appropriate value may be set. When the determination result of Step ST10 is YES, in Step ST11, the controller 13 determines whether or not an index representing a reception intensity of the received satellite radio wave is equal to or less than a predetermined value, for example, whether or not the C/N ratio is equal to or less than 36 dbHz. In this step, it is determined that there is a possibility of erroneous reception when the reception intensity is weak. When the determination result of Step ST11 is NO, it is determined that the time information is normally received, and thus the process proceeds to Step ST6. Then, in Step ST7, the time information is rewritten. Note that, the predetermined value serving as the threshold value of the C/N ratio in Step ST11 may be appropriately determined. Further, as the index representing the reception intensity of the satellite radio wave, an index other than the C/N ratio may be used.

On the other hand, when the received time information is unreliable, that is, when the result of Step ST10 is NO or when the result of Step ST11 is YES, the process proceeds to Step ST12 to receive TOW again. When TOW is received, in subsequent Step ST13, the controller 13 compares previously received TOW with subsequently received TOW to determine whether or not the difference therebetween is 6 seconds. When the result is YES, it is determined that the received time information is reliable, and the process proceeds to Step ST6. Otherwise, it is determined that reliable time information was not obtained, and the process ends without adjusting the internal time.

Note that, the flow described here represents an example of the operation of the satellite radio-controlled wristwatch 1 according to this embodiment. As long as the algorithm can realize a similar function, any flow may be adopted. Further, the conditions used for the respective determinations may be appropriately changed depending on the assumed use conditions and specifications of the satellite radio-controlled wristwatch 1.

By the way, in the above-mentioned shortened time adjustment operation, the internal time is adjusted by receiving only the preamble representing the timing of every 6 seconds. Therefore, when the internal time is adjusted so as to cross the timing to update the date information (in the case of WN, 0:00 AM on Sunday in GPS time), depending on the condition, the value of WN stored in the date information storage unit 22 may be erroneously updated.

Figure 8:
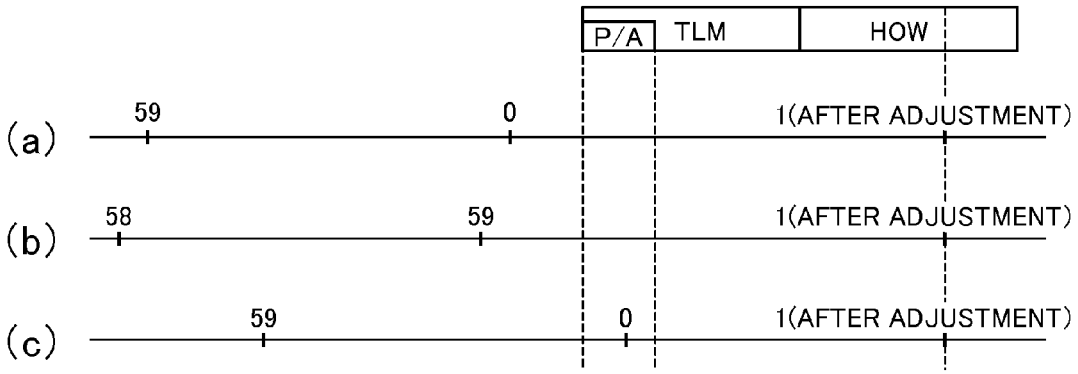
FIG. 8 is a view illustrating timings of respective seconds in an internal time when the shortened time adjustment operation is carried out around the timing to update information relating to a date.

FIG. 8 is a view illustrating timings of respective seconds in the internal time when the shortened time adjustment operation is carried out around the timing to update the information relating to the date. In FIG. 8, the horizontal axis represents time, and the right direction represents the elapse of time.

In FIG. 8, symbol "P/A" in the upper part represents the preamble transmission timing, and symbols "TLM" and "HOW" represent the TLM transmission timing and the HOW transmission timing, respectively. Further, the three time lines with symbols (a), (b), and (c) represent the timings of seconds of the internal time, and the internal times of the respective lines are shifted from the accurate time differently from each other. Further, the second represented by "0" in each time line is the timing to update the date information, and the date information stored in the date information storage unit 22 is updated at this timing. In the case of this embodiment, WN stored in the date information storage unit 22 is incremented by 1. Further, the second represented by "1" in each time line is a second that first arrives after the preamble is received. The last second is shortened or extended so that the internal time represents the accurate second at this timing, and the internal time is rewritten.

The time line of (a) represents a state in which the internal time is slightly fast. In this case, the timing to update the date information in the internal time arrives before the reception of the preamble. Therefore, the date information is updated, and then the time information is adjusted. Thus, the date information is accurately updated.

The time line of (b) represents a case where the internal time is late, in particular, a case where the amount of the lag is larger than the length of the preamble. In this case, the second is extended prior to arrival of the timing to update the date information in the internal time before the reception of the preamble. As a result of the adjustment of the time information, the date information is not updated based on the internal time, and the date information is set to an erroneous value.

On the other hand, the time line of (c) represents a case where the internal time is late similarly to the case of (b), but the amount of the lag is smaller than the length of the preamble. In this case, the timing to update the date information in the internal time arrives before the reception of the preamble is completed, and hence the time information is adjusted after the date information is updated. Consequently, the date information is accurately updated.

In view of the above, it is preferred that the controller 13 of the satellite radio-controlled wristwatch 1 according to this embodiment carry out any one of the following control so as to prevent the date information from taking an erroneous value due to the shortened time adjustment operation.

<Control 1>

In this control, the date information is updated only in the case of (b) described with reference to FIG. 8. The conditions thereof are as follows: the internal time is adjusted so as to cross the timing to update the date information, that is, the preamble reception time point (time at the head of the subframe) is within a predetermined range from the time point at which the date information is updated, and the date information has not been updated at a time point at which the internal time is adjusted. Specifically, in the case of this embodiment, the former condition corresponds to a case where the difference between the preamble reception start timing and the timing to update the date information in the internal time is, for example, less than 3 seconds. Note that, this condition may be appropriately determined so that the difference between the preamble reception start timing and the timing to update the date information in the internal time is one of less than and equal to or less than an arbitrary certain value. For example, in view of the fact that, in Step ST5 in FIG. 7, the shortened time adjustment operation is not executed when the difference between the preamble transmission timing and the internal time is equal to or more than 1 second, this condition may include achieving a state in which the difference between the preamble reception start timing and the timing to update the date information in the internal time is less than 1 second. Further, in the latter condition, the second represented by "0" in the internal time illustrated in FIG. 8 has not arrived at the time point at which the internal time is adjusted. When those two conditions are satisfied, the controller 13 increments the value of WN stored in the date information storage unit 22 by 1 at the time point at which the internal time is adjusted, to thereby update the date information.

<Control 2>

In this control, when the internal time is to be adjusted so as to cross the timing to update the date information as illustrated in FIG. 8, the shortened time adjustment operation is inhibited. The condition of this case is as follows: the preamble reception time point (time of the head of the subframe) is within a predetermined range from the time point at which the date information is updated, that is, in the case of this embodiment, the difference between the preamble reception start timing and the timing to update the date information in the internal time is one of less than and equal to or less than an arbitrary certain value, for example, less than 3 seconds. In such a case, the controller 13 inhibits the shortened time adjustment operation itself, and the time is not adjusted.

Any of the above-mentioned controls may be adopted. Further, in control 2, when the shortened time adjustment operation is inhibited, the normal time adjustment operation may be carried out instead of preventing the time from being adjusted.

Note that, the embodiment described above is merely an example for carrying out the invention, and the present invention is not limited to the specific shapes, arrangement, and configuration described in the embodiment. In particular, the arrangement, numbers, and designs of various members are matters to be appropriately designed by the person skilled in the art as necessary.

The invention claimed is:

1. A satellite radio-controlled wristwatch, comprising:

a satellite radio wave reception unit comprising an antenna for receiving a satellite radio wave, a high frequency circuit, and a decoder circuit;

a clock circuit for holding and counting an internal time; and a controller which controls a time information acquisition operation of acquiring time information from the satellite radio wave received by the satellite radio wave reception unit, the controller being configured to selectively execute, in the time information acquisition operation, based on error evaluation of the internal time:

a shortened time adjustment operation of ending the time information acquisition operation at a stage at which head information that is preamble data of a fixed value representing a head of unit information is received, and adjusting the internal time based on a timing at which the head information is received; and a normal time adjustment operation of receiving the time information, and adjusting the internal time based on the time information.

2. The satellite radio-controlled wristwatch according to claim 1, wherein, in the shortened time adjustment operation, the controller executes the normal time adjustment operation when an adjustment amount of the internal time is equal to or more than a predetermined value.

3. The satellite radio-controlled wristwatch according to claim 1, wherein in the normal time adjustment operation the controller receives the time information a first time and a second time when an adjustment amount of the internal time is equal to or more than a predetermined value or when an index representing a reception intensity of the received satellite radio wave is equal to or less than a predetermined value, and adjusts the internal time when the time information received the second time matches with the first time information received.

4. The satellite radio-controlled wristwatch according to claim 1, wherein the clock circuit holds information relating to a date to be updated when the internal time counted by the clock circuit arrives to a time point at which the date information is required to be updated, and wherein, in the shortened time adjustment operation, the controller updates the information relating to the date at a time point at which the internal time is adjusted when a time point at which the head information is received is within a predetermined range from a time point at which the information relating to the date is updated in the internal time, and when the information relating to the date has not been updated at a time point at which the internal time is adjusted.

5. The satellite radio-controlled wristwatch according to claim 1, wherein the clock circuit holds information relating to a date to be updated when the internal time counted by the clock circuit arrives to a time point at which the date information is required to be updated, and wherein in the shortened time adjustment operation, the controller inhibits the shortened time adjustment operation when a time point at which the head information is received is within a predetermined range from a time point at which the information relating to the date is updated in the internal time.

* * * * *